United States Patent [19]

Morishima et al.

[11] 4,050,676

[45] Sept. 27, 1977

[54] MIXING DEVICE AND ELEMENT THEREFOR

[76] Inventors: Yasushi Morishima, 836, Aza Mori, Kokuba 1-chome, Otsu; Yukifusa Miyazaki, 550, Aza Iwaden, Yabase-cho, Kusatsu, both of Japan

[21] Appl. No.: 636,953

[22] Filed: Dec. 2, 1975

Related U.S. Application Data

[63] Continuation of Ser. No. 462,537, April 19, 1974, abandoned.

[51] Int. Cl.[2] ..... B01F 15/00

[52] U.S. Cl. ..... 366/339

[58] Field of Search ..... 259/4; 138/42–43; 48/180 M

[56] References Cited

U.S. PATENT DOCUMENTS

| | | | |
|---|---|---|---|
| 2,085,132 | 6/1937 | Underwood | 259/4 AB |
| 3,051,452 | 8/1962 | Nobel | 259/4 AB |
| 3,394,924 | 7/1968 | Harder | 259/4 AB |
| 3,846,229 | 11/1974 | Kallmes | 259/4 AB |

*Primary Examiner*—Harvey C. Hornsby
*Assistant Examiner*—Robert Pous
*Attorney, Agent, or Firm*—Haseltine, Lake & Waters

[57] ABSTRACT

A mixing device comprising a plurality of mixing elements, each consisting of at least two passages which are arranged parallel, in a row, and are provided with spiral vanes therein, and through which fluid to be mixed passes, and a collecting and dividing chamber which is common to the passages, in which the fluid to be mixed is collected and then divided in subsequent passage, the elements being arranged in series in such a way that a line extending between the centers of the passages in one element intersects the corresponding line of an adjacent element. The elements of the device are also covered.

8 Claims, 11 Drawing Figures

Fig. 4-1
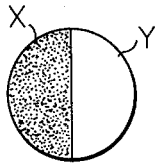
Fig. 4-2
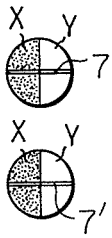
Fig. 4-3
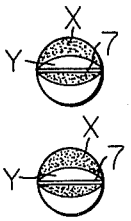
Fig. 4-4
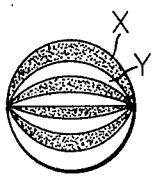
Fig, 5-1
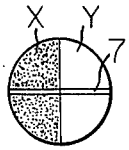
Fig. 5-2
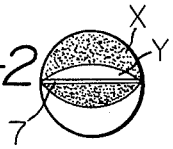
Fig. 6-1
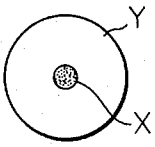
Fig. 6-2
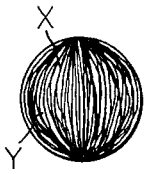
Fig. 6-3
PRIOR ART
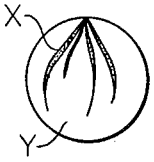
Fig. 7-1
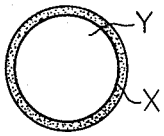
Fig. 7-2
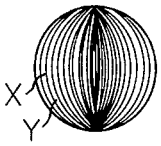
Fig. 7-3
PRIOR ART
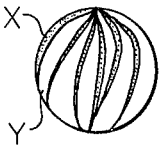

MIXING DEVICE AND ELEMENT THEREFOR

This is a Continuing Application based on Ser. No. 462,537, filed Apr. 19, 1974, titled Mixing Device, now abandoned.

SUMMARY OF THE INVENTION

The present invention relates to a mixing device for mixing fluids and finely divided particles, and to the elements thereof. To date, a variety of apparatuses for mixing fluids such as liquid and gas and finely divided particles have been used. However, these known apparatuses include many disadvantages for users.

One such apparatus of the prior art, for example, as disclosed in U.S. Pat. No. 3,286,992, comprises a plurality of sheet-like elements, each adapted to divide a fluid duct into two channels, which are inserted into said fluid duct and serially arranged in point-contact with one another. In this particular prior art apparatus, the number of fluid divisions with respect to the transversal direction of the duct, along which the fluids to be mixed are directed after completely passing through all the elements, cannot exceed $2^N$, assuming that the number of the elements in N, since the operation of division and collection of the fluids to be mixed is merely repeated. In order to increase the mixing effect, N, i.e. the number of elements, must be increased.

In case two or more kinds of matter to be mixed are supplied into the apparatus, the resultant mixture is inevitably varied in proportion to the relative positions of the two added substances, thus decreasing the scope of application of the apparatus. In other words, if the two substances to be mixed are relatively positioned as shown in FIG. 6-1 and FIG. 7-1, the mixing effect is not sufficient, as shown in FIG. 6-2 and FIG. 7-2, respectively. This phenomenon will be explained in detail later.

Further, in order to attain a sufficient mixing effect in the apparatus, it is essential that the twist direction of the sheet-like elements differs from that of the adjacent sheet-like elements. This leads to increased costs of manufacturing and assembling of the apparatus. Moreover, the apparatus can only be adapted for mixing fluids and not finely divided particles, because the coefficient of friction between the particles is usually greater than that between the particles and the inner wall of the tube in which the particles are contained; accordingly, adequate mixing cannot be achieved.

In another prior art apparatus for the same purpose, for example, as disclosed in Belgian Pat. No. 578,478 or U.S. Pat. No. 3,239,197, the mixing effect cannot exceed $2^N$, similar to the above-mentioned prior apparatus, since the operation of division and collection of the fluids to be mixed is merely repeated.

In yet another prior art apparatus for the same purpose, for example as disclosed in U.S. Pat. No. 3,404,869 or U.S. Pat. No. 3,583,678, the mixing effect can be increased from $2^N$ to $4^N$ unlike the aforementioned apparatuses, since the fluids are divided into four passages and then collected in a chamber, and this procedure is successively repeated. However, in these apparatuses, since the passage diameter is limited and the passages cross each other, the ratio of pressure drop in the passages is extremely high and therefore the apparatuses cannot be used economically.

The principal object of the present invention is, therefore, to provide a fluid mixing device which satisfactorily overcomes the drawbacks of the prior art apparatuses as previously mentioned, by substantially improving the mixing effect and by substantially reducing the flow pressure drop.

Another object of the present invention is to provide a fluid mixing device which can easily and economically mix fluids, regardless of their viscosity.

A further object of the present invention is to provide a fluid mixing device capable of mixing finely divided particles or granules as well as fluids.

The fluid mixing device according to the present invention comprises a plurality of fluid mixer units each consisting of at least two fluid passages arranged parallel to each other and each provided with a spiral vane, the passages allowing the passage of fluids to be mixed, and a further fluid passage common to the two fluid passages to unite or divide the fluids to be mixed. The fluid mixer units are serially connected to one another so that a straight line extending between the centers of the two fluid passages intersects a corresponding straight line of the adjacent fluid mixer unit.

The term "fluid" as used in this specification generally refers to liquid or gas and sometimes includes substances such as powdery or granular matter, and "mixture" refers to mixing at least two kinds of liquid, gas or powdery or granular matter.

The term "fluids to be mixed" as used in this specification may refer to fluids or finely divided particles of two or more kinds which are different in their properties and compositions, fluids of a single kind but having uneven distribution of temperature within the passages, on to fluids of different hues, fluids having different viscosity distributions due to different rates of reaction or to different temperature distributions, and so on.

These fluids may have mutual or independent reactivities. Some of them present some reactions and the others present no reaction while passing along the interior of the passages. The mixing element for use in the inventive mixing device includes the at least two fluid passages as explained before, the axes of which are all in a common plane, the entry edge line of the vane in one passage being substantially parallel to that of another passage, that line intersecting with the common plane at approx. 70° to 110°.

BRIEF EXPLANATION OF THE DRAWINGS

The present invention will now be described with reference to the accompanying drawings which illustrate a preferred embodiment of the invention, and wherein

FIG. 4-1 through FIG. 8-4 are views showing positions of substances during mixing procedures, also referring to the prior art in FIGS. 6-3 and 7-3;

FIG. 10-1 through FIG. 10-3 are views showing elements of the mixing device, FIG. 10-1 is a side view, FIG. 10-2 is a partial sectional view taken along the line X—X of FIG. 10-1 and FIG. 10-3 is a top plan view.

DETAILED EXPLANATION OF THE INVENTION

Figure 1:
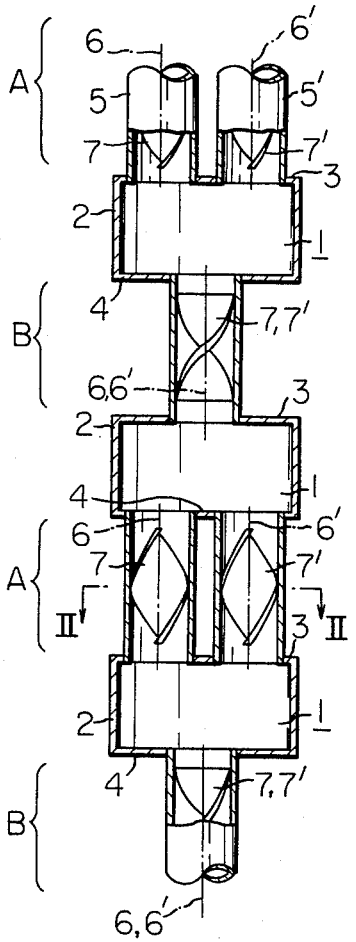
FIG. 1 is a partial sectional view of the mixing device according to the present invention.
Figure 2:
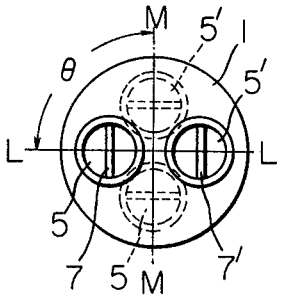
FIG. 2 is a sectional view taken along the line II—II of FIG. 1.

Referring to FIGS. 1 and 2, the mixing device comprises at least two units A and B consisting of two cylindrical passages 5, 5' having substantially the same inner diameter, the passages 5 and 5' of each unit being arranged parallel to each other and central axes 6, 6' thereof being positioned in the same plane. The passages 5 and 5' are fixedly provided therein with spiral vanes 7 and 7', respectively. Passages 5 and 5' of unit A communicate, in series, with passages 5 and 5' of adjacent unit B through a chamber 1, common to the fluid passages 5, 5' to unite or collect and divide fluids to be mixed. More specifically chamber 1 is adapted for collecting therein fluids from passages 5 and 5', and then dividing again the collected fluids into adjacent downstream passages 5 and 5'.

The fluid passage 1 includes a cylindrical body 2, an upper cover 3 and a lower cover 4 which together form a cavity therein. As can be seen from FIG. 2, a straight line L—L extending between centers of the two fluid passages 5, 5' intersects a corresponding line M—M of the adjacent unit at an angle $\theta$.

The number of fluid passages in a unit is preferably two or three, but it will be easily understood that four or more fluid passages may be provided. In the present invention the angle of torsion of the vane fixed in the fluid passage is, if the substances to be mixed are liquid or gas, usually within a range from 150° to 220°, but preferably 180°. When the substances to be mixed are finely divided particles, the angle of torsion is within a range from 60° to 120°, but preferably 90°. If the angle of torsion is not within the above range, the mixing effect is extremely lowered.

Figure 3:
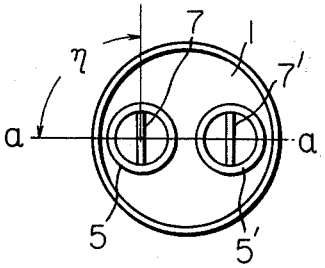
FIG. 3 is a view of the positional relationship of the spiral vanes, with a line linking the center of each passage.

According to a feature of the present invention, if the matter to be mixed is a fluid, the spiral vanes 7 and 7' are formed at an angle $\eta$ with respect to the line L—L extending between the center of said fluid passages 5, 5' respectively. The value of $\eta$ may be selected from within a range of 90° ± 20°, but preferably it is 90°, as shown in FIG. 3. If the angle $\eta$ is not within said range, the mixing effect is extremely lowered. Also, in the event the matter is finely divided particles, the spiral vanes are arranged, at their upstream end portions, similar to FIG. 3.

According to another feature of the present invention, a plurality of units A and B including two or three fluid passages are axially and serially connected to each other through a common chamber for collecting and dividing fluid to be mixed. The chamber has portions with a maximum inner diameter larger than the total diameters of the passages. For example, when two passages are provided in the unit, the maximum inner diameter of the chamber is greater than twice the inner diameter of one passage. The fluids from two passages, for example in unit A, are united and the speed of the current decreases in the chamber since the chamber is wider than the individual passages. The united fluids, then, are divided again and flow into the downstream two passages of unit B.

Thus, a motionless mixing device by which an excellent mixing effect is achieved and which could not have been obtained from prior arts is provided by the inventive combination of said chamber and the unit including fluid passages with spiral vanes therein. Moreover, the mixing device according to the present invention can be used to mix various kinds of matter, regardless of its viscosity, since the flow pressure drop and flow resistance are negligible. The inner diameters of the passages in all units are preferably equal to each other, otherwise the flow resistance would be increased and the mixing effect would be decreased.

Figure 9:
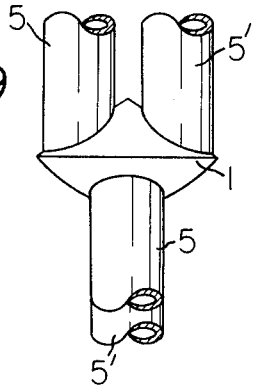
FIG. 9 is a view of another embodiment of the chamber of the mixing device.

Although chamber 1 is formed as a cylindrical body, as shown in FIG. 1, it may be formed as a conical body, as shown in FIG. 9, or as other shapes, for example, as a spherical body (not shown).

The mixing device according to this invention comprises at least one assembly consisting of at least two units A and B, each including at least two fluid passages, and at least one collecting and dividing chamber which is common to the two units. The number of assemblies can be modified according to the use of the mixing device. Moreover, two or more mixing devices can be used in co-operation with one another.

Figures 1, 10:
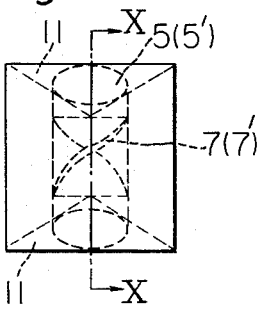
Figures 2, 10:
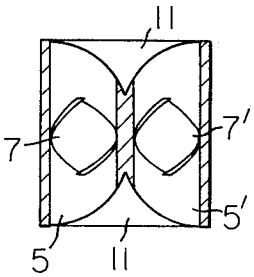
Figures 3, 10:
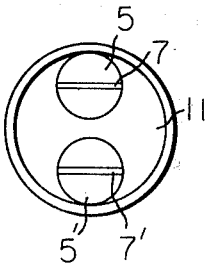

In the device according to this invention, each fluid passage and the collecting and dividing chamber may be formed separate from each other as shown in FIG. 9, or may be integrally formed. That is, in the latter case, as shown in FIG. 10-1 through 10-3, an element comprising two fluid passages 5, 5' with spiral vanes 7, 7' therein and portions at the ends of the element forming a part of the collecting and dividing chamber 11 can be provided. In this case, the chamber can be formed by connecting two elements.

The number of fluid passages is preferably two or three for the following reason.

Figure 11:
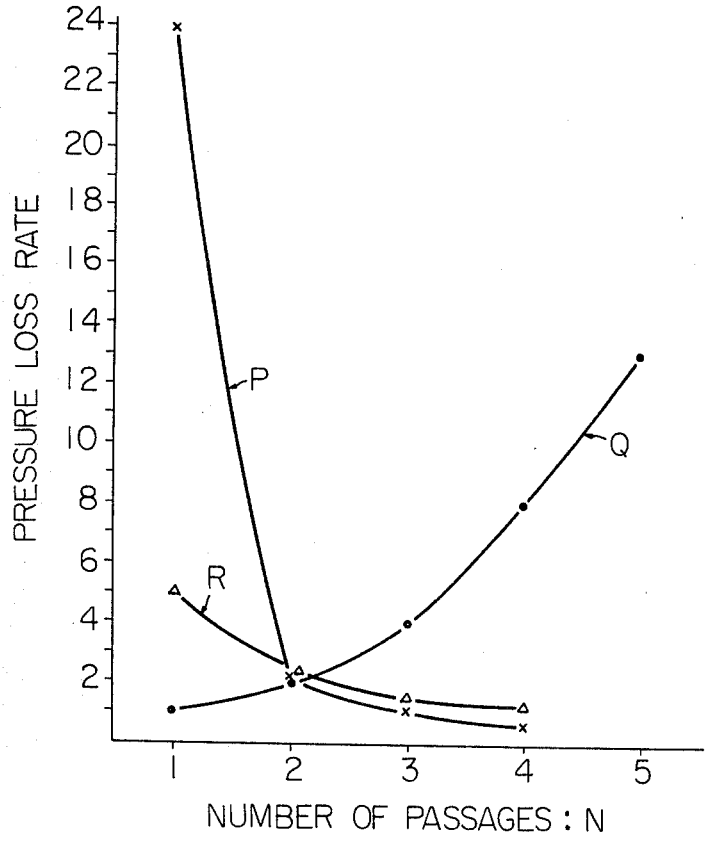
FIG. 11 is a graph of the ratio of pressure drop in relation to the number of passages.

In FIG. 11 which shows the relation between the ratio of pressure drop and the number N of the passages in one unit, the vertical axis represents the ratio of pressure drop; the horizontal axis, the number of passages in one unit. The curved lines P, Q, R respectively represent mixing effect with the physical length of the mixing being constant, mixing effect with the outer diameter of the element being constant, and mixing effect with the speed of the current in the passage being constant respectively. Referring to line P, in the case where N = 1, the ratio of pressure drop is extremely high and therefore, the mixing device is undesirable for practical purposes. Referring to line Q, in the case of N being equal to or greater than 4, the ratio of pressure drop is also high and it is impossible to use the device economically. As can be obviously understood from the above description, the mixing device is most effective when the number N is selected to be two or three.

The advantages and effectiveness of the present invention will now become apparent with refererence to the following further description.

With the device according to this invention, the number of fluid divisions (i.e. the mixing effect) with respect to the transversal direction of the passage, along which the fluids to be mixed are directed after completely passing through all the elements (one element being shown in FIG. 10-1 or 10-2), are $4^N$ on the assumption that the number of said elements is N.

Figures 1, 8:
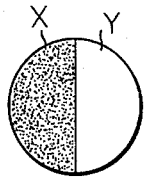
Figures 2, 8:
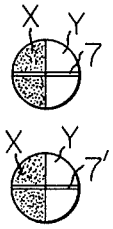
Figures 3, 8:
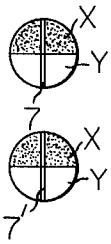
Figures 4, 8:
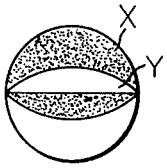

Referring now to FIG. 4-1 through FIG. 4-4, if the fluids X and Y enter the collecting and dividing chamber in the positions shown in FIG. 4-1, that is fluid X occupies the left half and fluid Y the right half, the fluids are divided into two above and below and flow into two passages 5 and 5' as shown in FIG. 4-2. The fluids passing through the passages are displaced by the vortex effect caused by the spiral vanes 7, 7' and accordingly occupy the positions as shown in FIG. 4-3.

The fluids from passages 5 and 5′ are united again in the collecting and dividing chamber as shown in FIG. 4-4. As a result of this, the fluid consisting of two phases as shown in FIG. 4-1, becomes a fluid consisting of eight phases as shown in FIG. 4-4. These operations are repeated and the mixing effect is $4^N$.

In the event the number of passages is three, the mixing effect is $6^N$. Moreover, as the length of the element compared to the inner diameter of the passage can be shorter the number of elements which can be provided in passages having a given length and inner diameter, and the effect of mixing one element can increase in comparison with apparatuses of the prior art.

In addition, the mixing effect does not depend upon the starting position of the two kinds of fluids with respect to the transversal section of the passage. For example, as shown in FIG. 6-1, if fluid X is positioned in the center portion of the passage and fluid Y is positioned surrounding fluid X in the passage, it was experimentally confirmed that the state of the fluid after passing through five elements of the mixing device is shown in FIG. 6-2, whereas with the prior art, fluids in the same starting positions are mixed to the extent shown in FIG. 6-3. From this result, it is obvious that the mixing effect of the present invention is far better than that of the prior art.

The same result holds true also in FIG. 7-1. In FIG. 7-1, fluid X is positioned adjacent to the inner periphery of the passage and fluid Y occupies the greater part of the inner portion of the fluid passage. The state of the fluid after passing through five elements is shown in FIG. 7-2 and FIG. 7-3. The former represents the effect of the present invention and the latter the effect of the prior art. It should be noted that in the two units, i.e. units A and B, the twisting directions of the spiral vanes have no relation to the mixing effect whereas in the prior art, the twisting directions of the spiral vanes in one unit has to differ from that of an adjacent unit.

This is because in the present invention, although revolving force is given to the fluid in the chamber by the spiral vanes, since passages 5 and 5′ are parallel to each other and their spiral vanes are fixed with the same twisting direction, the fluids are subject to the revolving force in the same direction and the fluids from two passages interact with each other in the chamber.

In addition to this, as the speed of the current in the chamber decreases, as previously mentioned, the revolving force applied to the fluid further decreases. Therefore, the revolving force is negligible when the fluids enter the downstream passage. As a result, it is not necessary for the twisting direction of the passages in one unit to reconcile with that of the passages in the adjacent unit. This lowers the cost of manufacturing and assembling the mixing elements.

The present invention can also mix finely divided particles or granules. The coefficient of friction between the particles or granules is usually greater than that between the particles and the inner wall of the passage. If particles X and particles Y are positioned on the left and right as shown in FIG. 8-1 and enter the collecting and dividing chamber, the particles are separated into two, above and below in the chamber as shown in FIG. 8-2 and flow into the two passages 5 and 5′ where the particles are shifted by the function of the spiral vane, to the state shown in FIG. 8-3. The particles slide on the inner wall, since the coefficient of friction between the particles is greater than that between the inner wall and the particles, as previously mentioned. The particles enter the chamber in the state shown in FIG. 8-4. That is, the particles consisting of two phases are mixed and become four phases.

Referring now to Table 1, the advantages of the present invention will become more clear when compared to the prior arts.

Table 1

| | (S) | | | (T) | | | (U) | | | (V) | | |
|---|---|---|---|---|---|---|---|---|---|---|---|---|
| | (1) | (2) | (3) | (1) | (2) | (3) | (1) | (2) | (3) | (1) | (2) | (3) |
| Case (I) | 1 | 12 | 13 | 1 | 0.33 | 1 | 1 | 1 | 1 | — | — | — |
| Case (II) | 1 | 1 | 1 | 1.3 | 1 | 2.6 | 1 | 2.3 | 1.9 | — | — | — |
| Case (III) | 1 | 2.5 | 3 | 1.57 | 1 | 2.2 | 1 | 1.9 | 1.4 | 1 | 1 | 1 |

Table 1 shows the relationship between ratio of pressure drop, outer diameter, length of the mixer and average velocity of current in the passage, while mixing effect and flow rate remain constant. In Table 1, (S) represents the ratio of pressure drop; (T) the ratio of the diameter of the element; (U) the ratio of the length of the mixing device; (V) the average speed of the current in the passage. Column (1) covers the present invention; (2) U.S. Pat. No. 3,286,992; and (3) U.S. Pat. No. 3,404,869 or U.S. Pat. No. 3,583,678. Case (I) shows the relationship between (S) and (T) with (U) being constant; case (II) the relationship between (T) and (U) with (S) being constant; and case (III) the relationship between (S), (T) and (U) with (V) being constant.

Case (I) can be applied, for example, to the case of the mixing device being provided in a spinneret since the length of the mixing device is limited. It will be easily understood that the ratio of pressure drop in the apparatuses according to the prior art (2) and (3) are extremely high compared with the present invention (1). Therefore, in the prior art, an increase in power is essential.

Case (II) can be applied, for example, to the case where the power of a pump or the pressure in a pipe or tank is limited. It will be easily understood that the length of the mixer according to the prior art is longer than that of the present invention. This leads to an increase in the manufacturing cost of the mixing device. With respect to the diameter of the element, (2), i.e. U.S. Pat. No. 3,286,992 is superior to the present invention, however, it is rare that the diameter must be limited because of the use of the mixing device. Therefore, practically speaking, this disadvantage is negligible.

Case (III) can be applied, for example, to the case wherein the residence time of a polymer in a spinning machine is predetermined. The ratio of pressure drop and the length of the mixer in the prior art are larger and longer than those of the present invention. From the above description, it will be easily understood that the mixing device according to the present invention is superior to the mixer according to the prior art.

The unit shown in FIGS. 10-1 through 10-3, according to the present invention, may be formed with a body made of metals or plastics and with two spiral vanes 7 and 7′ which are also made of metals or plastics and which are inserted into and fixed onto a plurality of passages provided in the body.

The mixing device according to the present invention has a variety of uses, for example, to mix high viscosity polymer, annexing agents, lubricants, paints, or in a heat exchanger, in a blending process for cosmetics or medical supplies and others.

It is obvious from the above description that the present invention provides a motionless mixing device advantageously featuring an extremely high mixing effect, a negligible flow pressure drop and a small dimension, as well as being inexpensive and easy to manufacture, less expensive to operate because of decreased power requirements, and capable of high speed operation.

What is claimed is:

1. A device for mixing substances, such as fluids and finely divided particles, the device comprising: at least two mixing elements in a stacked, substantially axial, serially connected arrangement; each element including at least two parallel passages having substantially the same inner diameter and axes that are all in a common plane; with spiral vanes secured inside said passages, having straight entry edge lines, the entry edge line in one passage of each said at least two passages being substantially parallel to that of said vane in at least one other passage, and said entry edge lines intersecting the common plane at 70° to 110°; the common plane of one mixing element being out of phase by 60° to 120° with respect to that of a successively stacked mixing element; each element further including a collecting and dividing chamber provided on and connected to one end of said at least two passages; which chambers serially alternate with said passages; said chambers having portions with a transversal inner diameter somewhat larger than the sum of the inner diameters of the associated ones of said passages, the centers of said chambers being all substantially in the common plane; and a plane including a line extending between the centers of each of said at least two passages in one mixing element intersecting a plane including a corresponding line of the successive element; the substances being collected in said chambers, then divided into said at least two passages, further twisted therein by said vanes, again collected in a succeeding chamber, and still further divided in a direction different from a preceding divided direction into said at least two passages that are placed out of phase with respect to those of a preceding element, whereas the substances are alternatively twisted and multilayered, so that a complete mixing effect is attained.

2. The mixing device as defined in claim 1, wherein an angle is formed by the intersecting lines, which is within 60° to 120°.

3. The mixing device as defined in claim 1, wherein the twisting angle of said vanes is within 150° to 220°, for processing and mixing the fluids.

4. The mixing device as defined in claim 3, wherein the twisting angle of said vanes is 180°.

5. The mixing device as defined in claim 1, wherein the twisting angle of said vanes is within 60° to 120°, for processing and mixing the finely divided particles.

6. The mixing device as defined in claim 5, wherein the twisting angle of said vanes is 90°.

7. The mixing device as defined in claim 1, wherein outer edges of said vanes closely touch inner walls of said passages.

8. The mixing device as defined in claim 1, wherein said chambers of the mixing elements are cylindrical.

* * * * *